United States Patent [19]

Goldsberry

[11] Patent Number: 4,484,446

[45] Date of Patent: Nov. 27, 1984

[54] VARIABLE PRESSURE POWER CYCLE AND CONTROL SYSTEM

[75] Inventor: Fred L. Goldsberry, Spring, Tex.

[73] Assignee: W. K. Technology, Inc., Houston, Tex.

[21] Appl. No.: 470,446

[22] Filed: Feb. 28, 1983

[51] Int. Cl.[3] ..... F01K 25/10

[52] U.S. Cl. ..... 60/647; 60/651; 60/660; 60/671

[58] Field of Search ..... 60/643, 645, 647, 651, 60/671, 676, 660

[56] References Cited

U.S. PATENT DOCUMENTS 4,242,870 1/1981 Searingen et al. ..... 60/651
4,358,930 11/1982 Pope et al. ..... 60/651 X

OTHER PUBLICATIONS

Brown & Root, Inc. paper, "Gulf Coast Geopressured Geothermal Energy Study," Proceedings of the Second Geopressured Geothermal Energy Conference, 1976.

Baudat and Darrow paper, "Power Recovery In a Closed Cycle," CEP, Feb., 1980.

*Primary Examiner*—Allen M. Ostrager
*Attorney, Agent, or Firm*—Arnold, White & Durkee

[57] ABSTRACT

A variable pressure power cycle and control system that is adjustable to a variable heat source is disclosed. The power cycle adjusts itself to the heat source so that a minimal temperature difference is maintained between the heat source fluid and the power cycle working fluid, thereby substantially matching the thermodynamic envelope of the power cycle to the thermodynamic envelope of the heat source. Adjustments are made by sensing the inlet temperature of the heat source fluid and then setting a superheated vapor temperature and pressure to achieve a minimum temperature difference between the heat source fluid and the working fluid.

29 Claims, 4 Drawing Figures

VARIABLE PRESSURE POWER CYCLE AND CONTROL SYSTEM

The U.S. Government has a non-exclusive, irrevocable, royalty-free license in this invention with power to grant licenses for all governmental purposes pursuant to a Determination of Government Interest, Case No. 45-10, by the Commissioner of Patents and Trademarks.

BACKGROUND OF THE INVENTION

1. Field of the Invention

This invention relates generally to power cycles and control systems for power cycles. More particularly, this invention concerns a variable pressure power cycle and control system which is capable of adjusting pressure on the heating phase of the cycle in response to a variable heat source fluid inlet temperature.

2. Description of the Prior Art

In the past, a typical approach to designing the parameters for a power cycle has been to first select the cycle and then a working fluid for the cycle. The power cycle is selected based on its geometric compatibility with a heat source and a heat sink. The working fluid is selected based on the physical constraints imposed by the mechanics of the process.

The heat source and heat sink define a thermodynamic envelope within which the power cycle must operate. That is, because of the inefficiencies of heat transfer, a temperature difference will exist between the working fluid and heat source fluid in a heat exchanger and also between the working fluid and the heat sink.

The objective of the process designer is to devise a thermodynamic cycle that will encompass the largest possible area within the thermodynamic envelope defined by the heat source and the heat sink in order to maximize work output. For a constant heat source, i.e., a condensing vapor heat source, the rectangular shaped Carnot cycle describes a theoretically most efficient means of power generation. In practice, the conventional subcritical Rankine cycle, which has a boiling working fluid, most efficiently utilizes the available heat from a condensing vapor heat source.

When, however, the heat source is a liquid phase heat source in which the temperature of the heat source fluid drops through the heating phase of the cycle, the simple Rankine cycle is inefficient. Examples of liquid phase heat sources include liquid dominated geopressure-geothermal resources and processed waste liquids from processes such as petrochemical, nuclear and the like. The increase in energy demand makes recovery of the available energy from these resources an economically feasible proposition.

Many techniques have been used to alter the shapes of simple power cycles to approximate a series of Carnot cycles, either horizontally or vertically assembled, to match the declining temperature thermodynamic envelope of the heat source. For example, double boiling cycles have been utilized to more closely approximate the thermodynamic envelope. A major drawback of this system is that the cycle requires complex equipment including a two-phase heat exchanger, a mist extracter and a complex control system.

Recent studies have shown that a supercritical Rankine cycle is superior to the subcritical cycle in liquid phase heat source applications. Although a supercritical heat exchanger may have a larger surface area than a subcritical exchanger, it is simpler in mechanical design than the two-phase heat exchanger and mist extracter required for subcritical cycles. More pump work is generally required by the supercritical process due to the higher working pressures required for operation which in turn require more structural material in the piping and heat exchanger. In the past, the increased capital requirements for heavier hardware have led to economic compromises in cycle design based upon cheap fuel in favor of lower pressure processes. Further, higher heat transfer coefficients for two phase systems imply a reduction in heat exchanger surface area and hence a reduction in construction material requirements. These traditional arguments in favor of two phase systems have been weakened by a major shift in the cost relationship between energy and capital equipment brought about by increased energy demand.

Traditionally, power plant cycles are designed based on a fixed maximum pressure for the cycle. This maximum pressure occurs during the heating phase of the cycle and is maintained by varying the flow rate of the working fluid through the system.

These fixed pressure power cycle systems work well when the heat source maintains a constant inlet temperature and flow rate over time. However, when the inlet temperature of the heat source varies (e.g., a geopressure-geothermal heat source) or if it is desirable to move the power plant from one heat source to another heat source having a different inlet temperature or flow rate (e.g., moving the power plant from one geothermal well to another), a fixed pressure power cycle possesses an inherent shortcoming—inflexibility. Specifically, a fixed pressure cycle defines a thermodynamic envelope that is incapable of adjusting to substantially fill the changing thermodynamic envelope that is defined by a changing heat source or different heat sources. For variable heat source applications, it is therefore desirable to provide a power cycle in which the maximum pressure developed during the heating phase of the cycle can be varied, thereby varying the temperature over the heating phase to more closely match the temperature of the heat source for maximum heating efficiency. Further, it is desirable that a control system be provided to automatically adjust the heating phase pressure of the cycle in response to a changing heat source.

SUMMARY OF THE INVENTION

By means of the present invention, there is provided a variable pressure power cycle and control system which is capable of automatically adjusting the pressure of the working fluid over the heating portion of the cycle in response to a change in the inlet temperature or flow rate of the heat source liquid.

In one embodiment of the present invention, there is provided a variable pressure power cycle comprising a Rankine cycle having a variable thermodynamic envelope that substantially fills the thermodynamic envelope defined by a variable heat source. The variable cycle envelope has a temperature and pressure at a turbine inlet that is adjustable according to the inlet temperature of the variable heat source so that a minimum temperature difference between the heat source fluid and the working fluid over the heating phase of the cycle is maintained at a predetermined minimal temperature difference for efficient heat exchange.

In another embodiment of the present invention, the variable pressure power cycle comprises a supercritical Rankine cycle wherein the variable heat source comprises a liquid phase heat source.

In a further embodiment of the invention, there is provided a method of controlling a variable pressure supercritical Rankine power cycle. The first step of the method involves sensing the inlet temperature of the heat source liquid. Based on the heat source liquid inlet temperature and the working fluid and turbine utilized, a superheated vapor point for the working fluid is selected which defines an isobaric pressure curve for the working fluid over the heating phase of the cycle. This isobaric pressure curve has a temperature substantially approaching the temperature of the heat source fluid at a point along the heating phase of the cycle. The back pressure immediately upstream of a turbine inlet is then set to the pressure selected for the superheated vapor point. The next step is sensing the temperature of the working fluid at the superheated vapor point. The flow rate of the working fluid through the heating phase of the cycle is then regulated so that the temperature of the working fluid at the superheated vapor point is maintained.

In another embodiment, the method of the present invention further comprises sensing the temperature and pressure in the floating pressure condenser. The expansion curve for the turbine is then calculated based on the saturated vapor temperature and pressure for the existing conditions.

In a still further embodiment of the invention, there is provided an apparatus for controlling a variable pressure supercritical Rankine power cycle having means for sensing the inlet temperature of the heat source fluid. The apparatus also has means for selecting a superheated vapor point for the working fluid based on the heat source fluid inlet temperature and the working fluid and turbine utilized. This superheated vapor point defines an isobaric pressure curve for the working fluid over the heating phase of the cycle having a temperature substantially approaching the temperature of the heat source fluid at a point along the heating phase of the cycle. The apparatus further includes means for setting the back pressure immediately upstream of the turbine inlet to the pressure selected for the superheated vapor point, and means for sensing the temperature of the working fluid at the superheated vapor point. Further means regulates the flow rate of the working fluid through the heating phase of the cycle so that the temperature of the working fluid at the superheated vapor point is maintained.

In still another embodiment of the apparatus of the present invention, the back pressure setting means comprises a back pressure valve and the flow rate regulating means comprises a temperature control valve downstream of the feed pump. The working fluid comprises a paraffinic hydrocarbon and the heat source liquid comprises a geothermal brine.

In yet another embodiment of the apparatus of the present invention, the apparatus further comprises means for sensing the discharge temperature of the heat source liquid. If the discharge temperature is rising over time, the apparatus has means for reducing the flow rate of the heat source liquid or means for adding a parallel power cycle to the system.

It is therefore an advantage of the present invention that the power cycle is capable of adjusting to a changing heat source in order to maximize efficient heat exchange from the heat source to the working fluid and optimize work output.

Another advantage of the present invention is that the maximum pressure of the power cycle is automatically adjusted by a control system in response to changes in the heat source.

A further advantage of the invention is that a variable pressure design permits one basic plant design to suffice for any application within a wide range of heat sources.

DETAILED DESCRIPTION OF THE PREFERRED EMBODIMENTS

Figure 1:
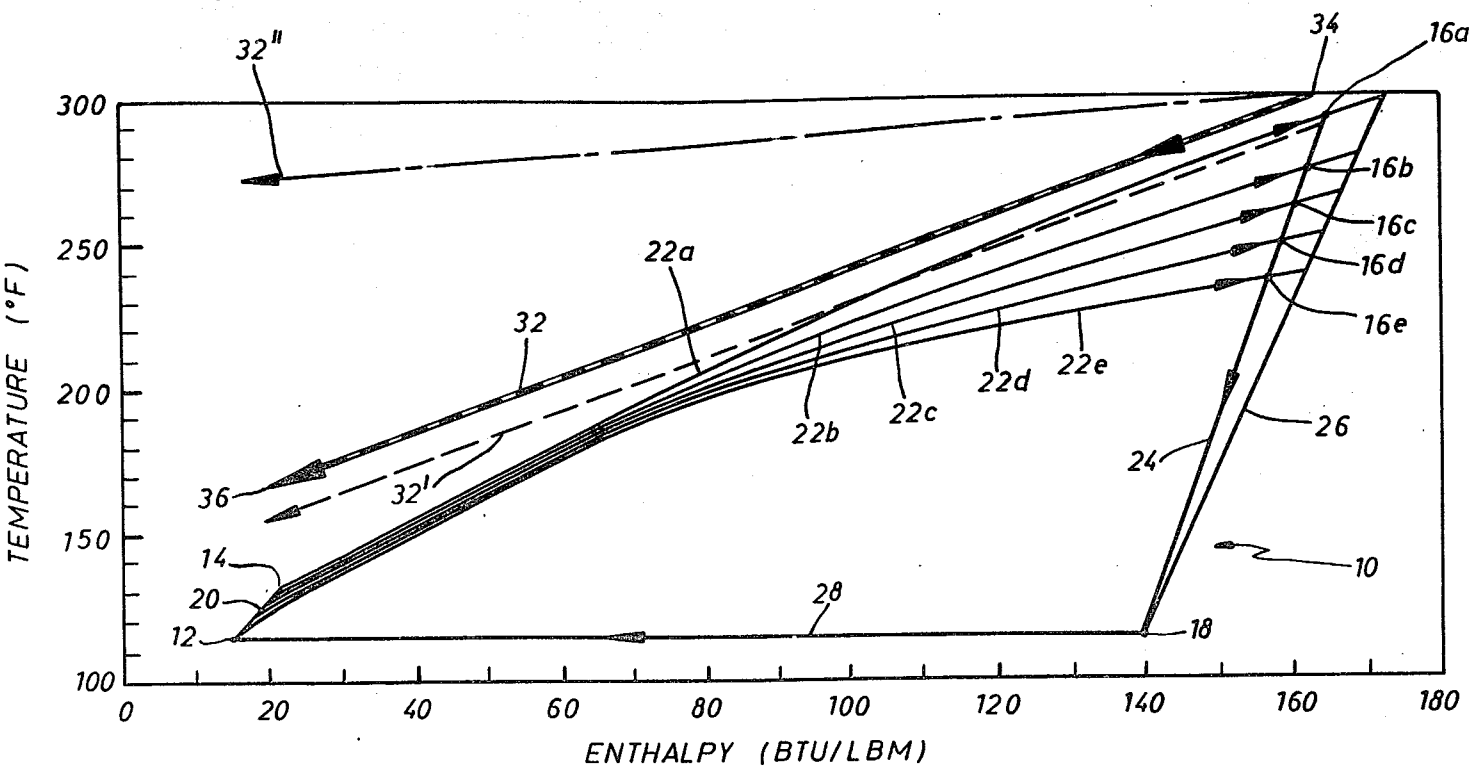
FIG. 1 is a temperature-Enthalpy diagram representing the supercritical variable pressure power cycle of the present invention.

Referring first to FIG. 1, there is shown a temperature-Enthalpy diagram of the supercritical variable pressure power cycle of the present invention for a geopressure-geothermal resource in which propane is the working fluid and brine is the resource liquid. Propane is the working fluid of choice for the supercritical cycle in the particular geopressure-geothermal application considered. It is desirable that the working fluid have a temperature somewhat below that of the expected range of temperatures to be encountered in the geopressure-geothermal resource liquid. Expected brine temperature will vary from 240° F. to 360° F. By comparison, propane has a critical temperature of 260° F. and critical pressure of 616 psia. The power cycle operating pressure for the heating phase of the cycle will vary from the critical pressure of the working fluid up to approximately 1200 psia at which point the propane will have a temperature of 290° F. Thus, the propane temperature range substantially matches the expected temperature range for the geopressure-geothermal resource.

For heat source liquid temperatures above 360° F., it is desirable to utilize a paraffinic hydrocarbon having a higher molecular weight. For example, in the temperature range of 360° F. to 410° F., isobutane possesses the requisite critical pressure and temperature properties, while pentane is preferred between 410° F. and 520° F. Above 450° F., cracking of the working fluid, which creates non-condensable gases, becomes an increasing problem. Conventional flash steam systems are more appropriate for applications to resources at these higher temperatures.

The maximum working pressure is limited to 1200 psia by practical limitations on the power system. First, there are obvious mechanical limitations on handling pressures higher than 1200 psia. Second, there is a diminishing return between the incremental power generated at higher pressures and the propane pump work required to feed the heat exchanger. Applying reasonable expander and pump efficiencies to the calculations results in the conclusion that the incremental increase in power output is small between 1200 psia and 2000 psia and possibly negative above 2000 psia due to pump-expander irreversibilities. Consequently, working pressures above 1200 psia (600 psia ASME flanges) are considered to be economically impractical at this time.

The supercritical variable pressure power cycle is indicated generally at 10 in FIG. 1. Power cycle 10 has a saturated liquid propane point 12, high pressure liquid propane points 14*a*, 14*b*, 14*c*, 14*d* and 14*e*, variable superheated vapor points 16*a*, 16*b*, 16*c*, 16*d* and 16*e*, and a near saturated vapor point 18.

Between saturated liquid propane point 12 and high pressure liquid propane points 14*a* to 14*e*, the liquid propane is pumped from a condenser pressure of 150 to 300 psia and corresponding temperature of 80° to 140° F. up to a pressure at or above the critical value. The pressure range shown extends from 700 psia at point 14*e* to 1200 psia at point 14*a*. This pumping phase of the cycle is indicated at 20.

The high pressure liquid is then isobarically heated in the heat exchanger from the temperature at points 14*a* to 14*e* to a higher temperature at the superheated vapor points 16*a* to 16*e*. This heating phase of the variable pressure power cycle is indicated by lines 22*a*, 22*b*, 22*c*, 22*d*, and 22*e* corresponding to the variable pressure superheated vapor points 16*a*, 16*b*, 16*c*, 16*d*, and 16*e*.

Line 24 represents the expansion of the working fluid in a turbine having an 80% efficiency as compared to the 100% isotropic expansion line shown at 26. Vapor is fed into the turbine where it expands to produce work and is exhausted at the turbine outlet as a near saturated vapor, indicated at point 18. Condensing of the working fluid occurs between points 18 and 12 as indicated by line 28 utilizing ambient air as the heat sink.

Turbine expansion line 24 is established based on the type of turbine and working fluid selected for the process. Preferably, the power cycle operates with a floating condenser to match the ambient air temperature. The advantage of a floating condenser is a significant increase in plant efficiency. The disadvantage lies in operating the turbine at off-design conditions which can reduce plant capacity. It is preferable that a radial inflow single stage turbine be utilized in connection with the floating condenser because this turbine design is more flexible with regard to operation at off-design conditions than more conventional multi-stage machines associated with conventional steam generation plants. A further constraint on the turbine design is that it must also operate with a variable inlet pressure. For a turbine of radial inflow design, condensate in the exhaust stream can be tolerated at levels of less than 5%. A radial inflow turbine having a specific speed of 0.6, yielding an expander efficiency slightly above 80%, is operable within the imposed constraints. Thus, based on propane as the working fluid and a radial inflow turbine, the 80% expansion line 24 is established. Expansion line 24 represents a locus of points for required turbine inlet temperature and pressure conditions to achieve a saturated vapor turbine exhaust at point 18.

Figure 2:
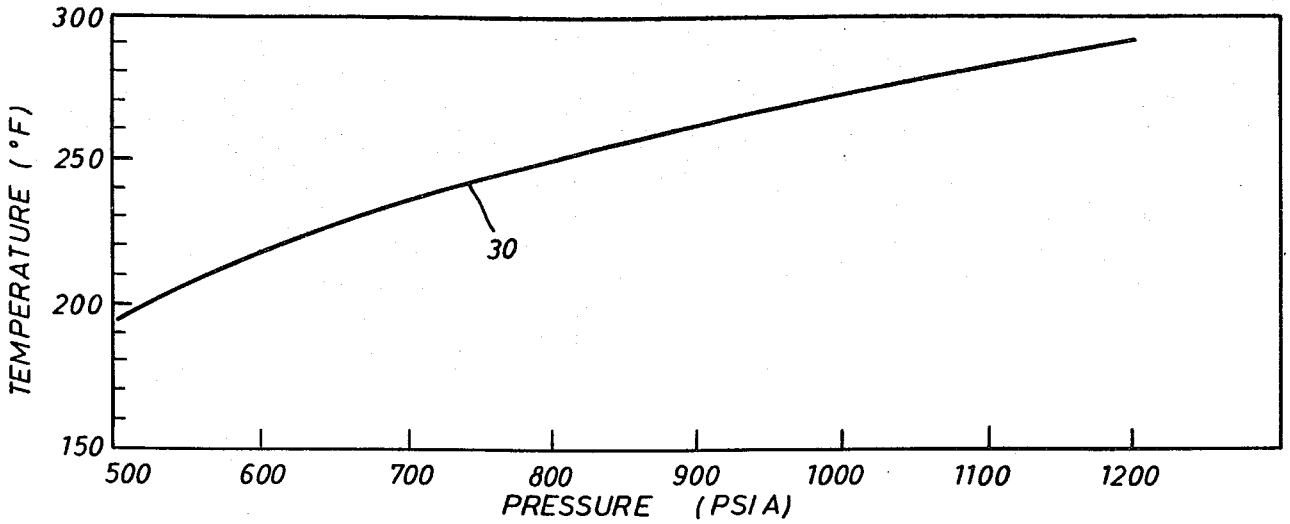
FIG. 2 is a diagram showing the temperature-pressure relationship required for propane at the superheated vapor point to achieve a saturated vapor exhaust from an 80% efficient radial inflow turbine.

Referring to FIG. 2, a line 30 is a plot of temperature versus pressure at the turbine inlet for propane in order to produce a saturated vapor turbine exhaust at point 18. This curve is generated by analyzing the expansion process for the selected radial inflow turbine and working fluid, propane.

Again referring to FIG. 1, points 16*a*, 16*b*, 16*c*, 16*d* and 16*e* are plots of the variable turbine inlet temperature and pressure conditions for the propane working fluid at variable pressures of 1200 psia, 1000 psia, 900 psia, 800 psia, and 700 psia, respectively. It will be appreciated that plotting of these five discrete points is for illustration purposes only. In operation, there is a continuous series of temperature and pressure turbine inlet points ranging from a maximum operating pressure for the cycle of 1200 psia down to a minimum critical pressure for propane of 616 psia.

Based on the variable pressure superheated vapor points at 16*a* to 16*e*, the isobaric pressure lines 22*a* to 22*e* are established. The brine cooling curve over the heat exchange phase of the cycle is indicated generally at 32. As shown in FIG. 1, the brine has a heat exchanger inlet temperature of 300° F. indicated at point 34 and a discharge temperature of approximately 160° F. at point 36. Brine cooling curve 32 is assumed to have a constant slope due to a constant specific heat for brine. On the other hand, the curvatures of the supercritical propane heating curves are pronounced. As the pressure of the propane increases from curves 22*e* to 22*a*, the curvature of the propane heating curves is reduced which allows better differential temperature matching between the brine and propane in the heat exchanger. This in turn provides more complete utilization of the heat in the brine.

The operating pressure for the power plant is a function of maximum achievable propane temperature. In practice, inefficiencies in the heat exchange process will create a temperature difference between the heat source liquid and the working fluid. This is dictated by practical limitations in heat exchanger design. Heat exchangers are typically designed for a minimum temperature difference over the heating cycle of 10° F.

Referring to FIG. 1, the desired 10° F. temperature difference for a brine resource having a 300° F. inlet temperature is achieved by setting the superheated vapor point pressure and temperature at point 16*a* and defining the heating curve for propane at 22*a*. If, on the other hand, the inlet temperature of the brine resource liquid drops to 285° F. as shown by the brine cooling curve at 32', the propane heating curve 22*a* is no longer operable. This is because the temperature of the propane following heating curve 22*a* would actually exceed the temperature of the resource as shown by the crossing lines 22*a*, 32'. For a brine resource having a cooling curve 32', the propane heating curve of choice would be that shown by line 22*b*. Thus, by varying the supercritical pressure at points 16*a* to 16*e* on the heating curve of the cycle, an efficient operating temperature difference can be maintained between the heat source liquid and the working fluid.

The heating curve for the propane is adjusted according to the inlet temperature of the brine resource by a control system that first senses the inlet temperature of the brine at 34. Optionally, the control system may also sense the ambient air temperature conditions of the condenser. If so, the control system will determine the appropriate 80% expansion line 24 based on the saturated vapor pressure and temperature for the existing atmospheric conditions. If not, an expansion line 24 is assumed which best fits the range of possible ambient conditions.

The control system then chooses an appropriate superheated vapor point temperature and corresponding pressure for the propane based on the pressure-temperature relationship for propane defined by curve 30. The initially chosen superheated vapor point simply seeks a predetermined temperature difference between the heat source inlet temperature and the superheated vapor point temperature. Following this initial selection, the controller calculates the minimum temperature difference over the heating phase of the cycle between the heat source liquid and the working fluid. This calculation is based on a predetermined cooling curve for the heat source liquid. Through an iterative process, the controller recalculates the superheated vapor point and adjusts the heat source liquid flow rate through the heat exchanger until the desired temperature difference between the heat source and working fluid is obtained at some point along the heating phase of the cycle.

Based on the selected superheated vapor pressure, the controller sends a signal to a back pressure valve located just upstream of the turbine inlet to establish the desired back pressure on the heating phase of the cycle. The process controller then senses the temperature at the turbine inlet and relays this information to a cutoff valve downstream of the feed pump. The required turbine inlet temperature, based on the pressure-temperature relationship defined by line 30, is achieved by varying the flow rate through the heating phase of the cycle. Thus, if the temperature at the turbine inlet is lower than that required for the proper pressure-temperature relationship for propane, the cutoff valve will reduce the flow of propane through the heating phase of the cycle. By reducing the flow, the propane is able to achieve a higher temperature in the heat exchange process. The process controller system continuously monitors resource inlet temperature and adjusts the system accordingly to achieve optimum efficiency.

Figure 3:
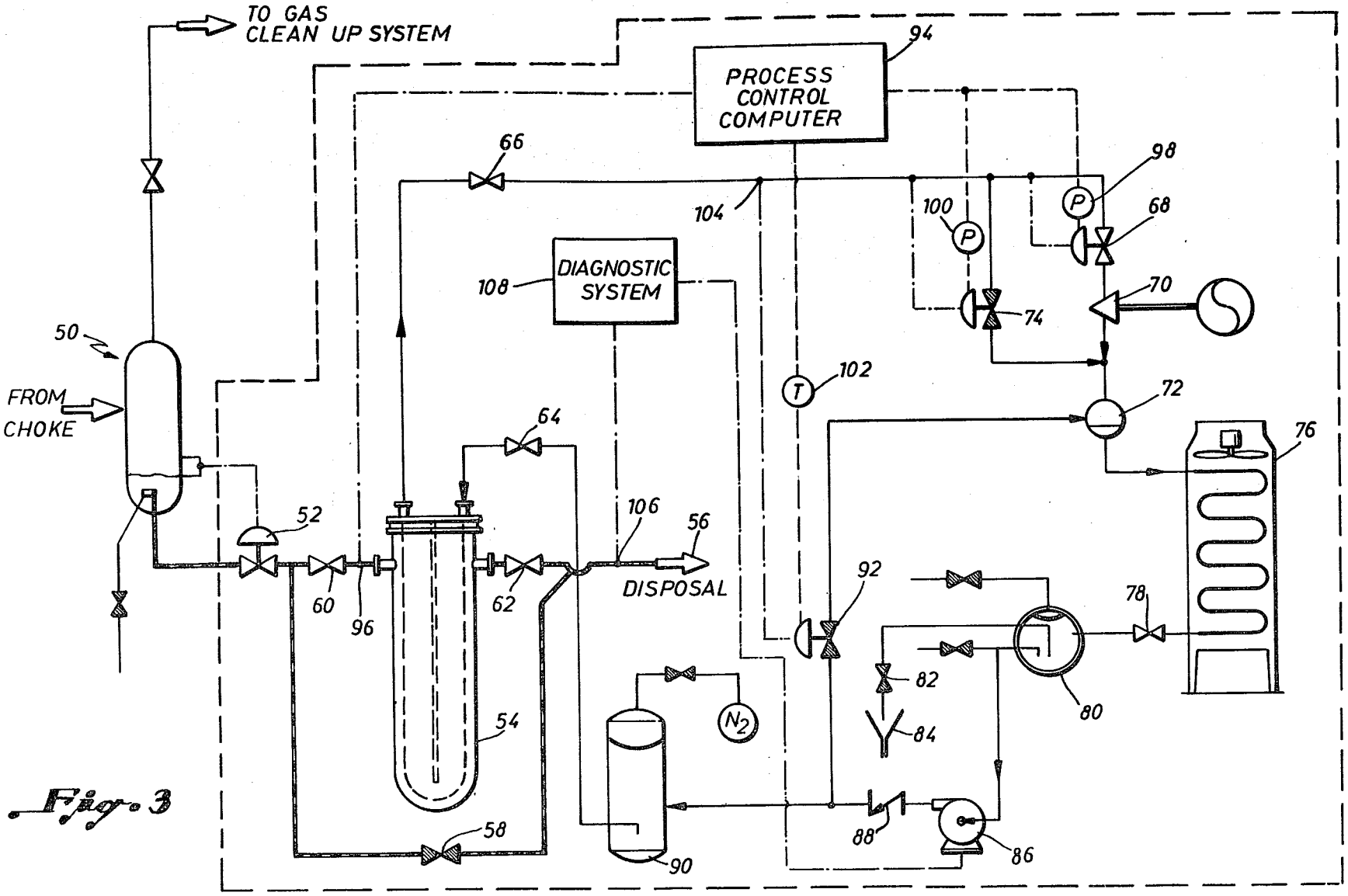
FIG. 3 is a schematic drawing of the variable pressure power cycle and control system of the present invention incorporated into a natural gas production system.

A schematic diagram of a preferred form of the variable pressure supercritical power cycle and process control system is shown in FIG. 3 incorporated into a natural gas processing system. The brine, as shown by the heavy dashed line, is diverted from the brine and gas production equipment shown generally at 50 through a level control valve 52 and into a shell and tube heat exchanger 54 on the shell side. The brine then flows to disposal at 56. The brine may be bypassed through a shutoff valve 58 (shown in a normally closed condition) for maintenance of the heat exchanger by closing shutoff valves 60, 62. Any liquid or gaseous process stream may be cooled in this manner. The working fluid, in this instance propane, is circulated in counterflow through heat exchanger 54 through block valves 64, 66 to a back pressure control turbine throttle valve 68. The propane then flows through an expansion turbine 70 and to a condensor inlet header 72. An alternate route may be taken through a back pressure sensing expansion valve 74 (shown in a normally closed condition) which functions in a similar manner but at a higher pressure setting to act as a safety device or bypass for routine maintenance.

The low pressure vapor exhaust is fed to an air cooled condenser 76. The subcooled liquid passes through shutoff valve 78 and is stored in an accumulator 80 which serves as the working fluid reservoir and contamination detection point. Any brine entering the process fluid can be collected, detected and dumped through shutoff valve 82 (shown in a normally closed condition) to a sump 84. Accumulator 80 also acts as the head tank to feed the process feed pump 86. Feed pump 86 boosts liquid pressure, forcing the propane through a primary check valve 88 into a nitrogen charged pulsation damper 90. Feed pump 86 flow is controlled by a temperature sensing bypass valve 92 (shown in a normally closed condition) that can act singly or be part of the pump valve unloading process. Bypass valve 92 maintains working fluid discharge temperature from heat exchanger 54 at the desired temperature required for the process pressure level.

The process control device 94, which controls the entire power cycle, can be a digital, mechanical analog, or electrical analog device, although a digital device is preferred for its programming capabilities. Process controller 94 in turn receives information from sensors and transmits information to control valves through either a hydraulic, pneumatic, or electrical transfer system.

The function of the process controller can be described as follows. Controller 94 senses the temperature of the heat source liquid, in this case geothermal brine, at a point 96 where it enters heat exchanger 54. Using the temperature at point 96, controller 94 logically generates the high side process pressure setting for back pressure control valves 68, 74 and the setting for temperature control valve 92 based on the pressure-temperature relationship for propane at the superheated vapor point. The required pressure settings are transmitted to valves 68, 74 from controller as shown at 98, 100, respectively. Likewise, the proper temperature setting is transmitted to valve 92 as shown at 102. Valves 68, 74 regulate the process pressure against which feed pump 86 is circulating the working fluid.

Temperature control valve 92 regulates process fluid temperature by altering the flow rate through heat exchanger 54. This is done by first sensing the temperature of the working fluid at point 104, the turbine inlet. Temperature control valve 92 then compares the working fluid temperature at point 104 with the temperature required for propane as defined by the pressure-temperature relationship for propane at the superheated vapor point at the turbine inlet. If the temperature of the working fluid at point 104 is below this required temperature, this indicates that the capacity of heat exchanger 54 has been exceeded. In response, bypass valve 92 reduces the flow rate through heat exchanger 54. Bypass valve 92 recirculates part of the flow through condenser 76 to accumulator 80, thereby reducing flow through one side of heat exchanger 54. If the working fluid temperature at point 104 exceeds the required temperature, bypass valve 92 closes, allowing more working fluid to pass through heat exchanger 54.

The control system is designed to maximize heat transfer through exchanger 54 or to make maximum use of the heat that is available from the brine. Further, the control system is designed to maximize cycle efficiency with regard to wet expansion considerations for turbine 70.

A further refinement of the system is illustrated by referring once again to FIG. 1. An alternate brine cooling curve is shown at 32'' in which the outlet temperature has risen to 270° F. A high brine discharge temperature implies that the power plant is not removing heat and hence is not functioning efficiently. A slow rise in temperature over a period of weeks is indicative of scaling in the heat exchanger.

Referring to FIG. 3, diagnostics can be generated by sensing the brine discharge temperature at 106. Diagnostic system 108 can then determine whether the brine discharge is rising over time. If so, diagnostic system 108 can either reduce the flow rate of the brine or add one or more parallel power cycle units to the system. Alternatively, diagnostic system may simply alert an operator that the discharge temperature is rising and the operator can take the appropriate action.

Any parallel power unit added will automatically adjust its operation to optimum on its portion of the split resource liquid stream. The stream splitter can be as simple as parallel adjustable chokes or a sophisticated flow control system.

Additional diagnostics may be provided to sense the flow rate of the propane through the last cycle added to the system at pump 86. A low flow rate indicates that the last cycle is not operating economically. That is, the flow rate may be so low that costs of operating the last cycle exceed output of the cycle. Diagnostic system 108 can compare the measured flow rate to a predetermined minimum flow rate and remove the last power cycle from the system or alert an operator to do so.

Figure 4:
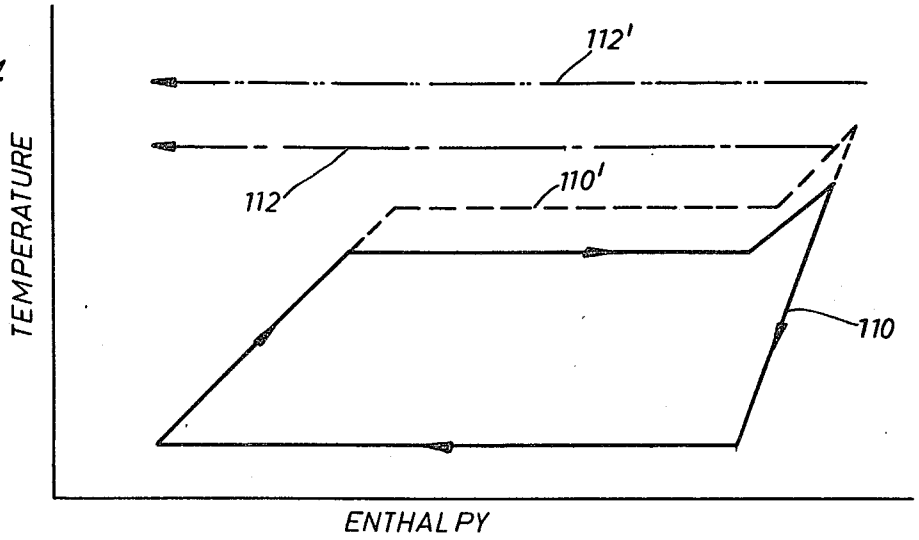
FIG. 4 is a temperature-Enthalpy diagram representing the variable pressure power cycle of the present invention for a subcritical cycle.

The variable pressure concept as applied to a conventional subcritical Rankine cycle is illustrated by the temperature-Enthalpy diagram of FIG. 4. The subcritical Rankine cycle is indicated generally at 110. Subcritical cycle 110 obtains heat from a condensing vapor heat source 112 which has a constant temperature over the heating phase of the cycle. It can be seen from the diagram that when the heat resource fluid temperature increases as shown by line 112', the temperature difference between the working fluid of subcritical cycle 110 and the resource fluid temperature 112' increases, causing a reduction in heat exchange efficiency. A variable pressure subcritical cycle adjusts the pressure and temperature over the heating phase of the cycle to 110' in order to more closely match the increased temperature of the heat resource 112'.

It may be appreciated that when a power plant is installed in an industrial processing facility and the heat source fluid is an industrial product, such as ammonia, it is preferable to choose ammonia as the working fluid of choice because those operating the plant will be most familiar with this product.

The foregoing description has been directed to particular embodiments of the invention in accordance with the requirements of the patent statutes for the purposes of illustration and explanation. It will be apparent, however, to those skilled in this art that many modifications and changes in the apparatus and processes set forth will be possible without departing from the scope and spirit of the invention. It is intended that the following claims be interpreted to embrace all such modifications and changes.

What is claimed is:

1. A method of generating power using a Rankine cycle with a turbine, a working fluid, and including a heating phase within a variable thermodynamic envelope that substantially fills a thermodynamic envelope defined by a variable temperature heat source fluid and a heat sink, comprising adjusting the temperature and pressure of the working fluid at the turbine inlet in response to changes in the inlet temperature of the heat source to maintain a minimum temperature difference between the heat source fluid and the working fluid during the heating phase of the cycle.

2. The method of claim 1, wherein the Rankine cycle comprises a supercritical Rankine cycle and the variable heat source fluid comprises a liquid phase heat source.

3. The method of claim 2, wherein the heat source liquid comprises a geopressure-geothermal brine and the working fluid comprises a paraffinic hydrocarbon.

4. The method of claim 3 wherein:

a. the turbine comprises a radial inflow turbine; and b. the working fluid comprises propane.

5. A method of controlling a variable pressure supercritical Rankine power cycle utilizing a turbine, a condenser, a feed pump and a working fluid and including a heating phase comprising the steps of:

a. sensing the inlet temperature of a heat source liquid;

b. based on the heat source liquid inlet temperature and the working fluid and turbine utilized, selecting a superheated vapor point for the working fluid defining an isobaric pressure curve for the working fluid over the heating phase of the cycle, the isobaric pressure curve having a temperature substantially approaching the temperature of the heat source liquid at a point along the heating phase of the cycle;

c. setting the back pressure immediately upstream of the turbine inlet to the pressure selected for the superheated vapor point for the working fluid;

d. sensing the temperature of the working fluid at the superheated vapor point; and e. regulating the flow rate of the working fluid through the heating phase of the cycle so that the temperature of the working fluid at the superheated vapor point is maintained.

6. The method of claim 5, further comprising the steps of:

a. sensing the temperature and pressure in the condenser, the condenser comprising a floating pressure condenser; and b. calculating an expansion curve for the turbine based on the saturated vapor temperature and pressure for the existing condenser temperature and pressure.

7. The method of claim 5 or 6, further comprising the steps of:

a. sensing the discharge temperature of the heat source liquid;

b. determining whether the discharge temperature of the heat source liquid is rising over time; and c. reducing the flow rate of the heat source liquid if the discharge temperature is rising over time.

8. The method of claim 5 or 6, further comprising the steps of:

a. sensing the discharge temperature of the heat source liquid;

b. determining whether the discharge temperature of the heat source liquid is rising over time; and c. adding a parallel power cycle to the system if the discharge temperature is rising over time.

9. The method of claim 8, further comprising the steps of:

a. sensing the flow rate of the working fluid through the last parallel power cycle added to the system;

b. comparing the measured flow rate of the working fluid to a predetermined minimum flow rate required for economical operation of the last parallel power cycle; and c. removing the last parallel power cycle from the system if the measured flow rate of the working fluid is less than the predetermined minimum flow rate required for economical operation of the last parallel power cycle.

10. An apparatus for controlling a variable pressure supercritical Rankine power cycle utilizing a turbine, a condenser, a feed pump, and a working fluid and including a heating phase comprising:

a. means for sensing the inlet temperature of the heat source liquid;

b. means for selecting a superheated vapor point for the working fluid based on the heat source liquid inlet temperature and the working fluid and turbine utilized, the superheated vapor point defining an isobaric pressure curve for the working fluid over the heating phase of the cycle having a temperature substantially approaching the temperature of the heat source liquid at a point along the heating phase of the cycle;

c. means for setting the back pressure immediately upstream of the turbine inlet to the pressure selected for the superheated vapor point for the working fluid;

d. means for sensing the temperature of the working fluid at the superheated vapor point; and e. means for regulating the flow rate of the working fluid through the heating phase of the cycle so that the temperature of the working fluid at the superheated vapor point is maintained.

11. The apparatus of claim 10, further comprising:

a. means for sensing the temperature and pressure in the condenser, the condenser comprising a floating pressure condenser; and b. means for calculating an expansion curve for the turbine based on the saturated vapor temperature and pressure for the existing condenser temperature and pressure.

12. The apparatus of claim 10 wherein:

a. the back pressure setting means comprises a back pressure valve; and b. the flow rate regulating means comprises a temperature control valve downstream of the feed pump.

13. The apparatus of claim 11 wherein:

a. the back pressure setting means comprises a back pressure valve; and b. the flow rate regulating means comprises a temperature control valve downstream of the feed pump.

14. The apparatus of claim 10 wherein:

a. the working fluid comprises a paraffinic hydrocarbon; and b. the heat source liquid comprises a geopressure-geothermal brine.

15. The apparatus of claim 11 wherein:

a. the working fluid comprises a paraffinic hydrocarbon; and b. the heat source liquid comprises a geopressure-geothermal brine.

16. The apparatus of claim 12 wherein:

a. the working fluid comprises a paraffinic hydrocarbon; and b. the heat source liquid comprises a geopressure-geothermal brine.

17. The apparatus of claim 13 wherein:

a. the working fluid comprises a paraffinic hydrocarbon; and b. the heat source liquid comprises a geopressure-geothermal brine.

18. The apparatus of claim 10 wherein:

a. the heat source liquid comprises an industrial product; and b. the working fluid comprises the industrial product.

19. The apparatus of claim 11 wherein:

a. the heat source liquid comprises an industrial product; and b. the working fluid comprises the industrial product.

20. The apparatus of claim 12 wherein:

a. the heat source liquid comprises an industrial product; and b. the working fluid comprises the industrial product.

21. The apparatus of claim 13 wherein:

a. the heat source liquid comprises an industrial product; and b. the working fluid comprises the industrial product.

22. The apparatus of claim 10, 11, 12, 13, 14, 15, 16, 17, 18, 19, 20 or 21, further comprising:

a. means for sensing the discharge temperature of the heat source liquid;

b. means for determining whether the discharge temperature of the heat source liquid is rising over time; and c. means for reducing the flow rate of the heat source liquid if the discharge temperature is rising over time.

23. The apparatus of claim 10, 11, 12, 13, 14, 15, 16, 17, 18, 19, 20 or 21, further comprising:

a. means for sensing the discharge temperature of the heat source liquid;

b. means for determining whether the discharge temperature of the heat source liquid is rising over time; and c. means for adding a parallel power cycle to the system if the discharge temperature is rising over time.

24. The method of claim 23, further comprising:

a. means for sensing the flow rate of the working fluid through the last parallel power cycle added to the system;

b. means for comparing the measured flow rate of the working fluid to a predetermined minimum flow rate required for economical operation of the last parallel power cycle; and c. means for removing the last parallel power cycle from the system if the measured flow rate of the working fluid is less than the predetermined minimum flow rate required for economical operation of the last parallel power cycle.

25. A method of converting heat from a variable liquid heat source to mechanical energy using a turbine, a condenser, a pump, a heat exchanger, and a working fluid to generate a supercritical Rankine cycle, the method comprising:

a. selecting a working fluid having a critical temperature less than the temperature of the heat source liquid;

b. vaporizing the working fluid isobarically by passing the working fluid in heat exchange with the liquid heat source at a supercritical pressure which maintains the working fluid at a preselected minimum temperature differential below the temperature of the heat source liquid during heat exchange;

c. expanding the vaporized working fluid to generate mechanical energy;

d. condensing and cooling the expanded working fluid;

e. raising the pressure of the condensed and cooled working fluid; and f. repeating the cycle of steps (b) through (e).

26. The method of claim 25, wherein the minimum temperature differential is maintained by:

a. controlling the pressure of the vaporized working fluid in response to changes in the temperature of the heat source liquid; and b. controlling the rate of flow of the working fluid.

27. A method as defined in claim 25 in which the heat source liquid has a given temperature between about 240° F. and 360° F., and the working fluid comprises propane.

28. A method as defined in claim 25 in which the heat source liquid has a given temperature between about 360° F. and 410° F., and the working fluid comprises isobutane.

29. A method as defined in claim 25 in which the heat source liquid has a given temperature between about 410° F. and 520° F., and the working fluid comprises pentane.

* * * * *